United States Patent [19]

Suzuki

[11] Patent Number: 4,649,228

[45] **Date of Patent: * Mar. 10, 1987**

[54] TRANSMISSION LINE

[75] Inventor: Hirosuke Suzuki, Tokorozawa, Japan

[73] Assignee: Junkosha Co., Ltd., Japan

[ * ] Notice: The portion of the term of this patent subsequent to Feb. 24, 2004 has been disclaimed.

[21] Appl. No.: 723,327

[22] Filed: Apr. 15, 1985

[30] Foreign Application Priority Data

Apr. 18, 1984 [JP] Japan ..... 59-55978[U]

[51] Int. Cl.[4] ..... H01B 7/34

[52] U.S. Cl. ..... 174/36; 174/115; 174/117 F

[58] Field of Search ..... 174/36, 115, 117 F, 174/70 R; 350/96.23; 333/1, 243

[56] References Cited

U.S. PATENT DOCUMENTS

| | | | |
|---|---|---|---|
| 3,688,016 | 8/1972 | Spade | 174/36 |
| 3,953,566 | 4/1976 | Gore | 264/175 X |
| 4,176,910 | 12/1979 | Noethe | 350/96.23 |
| 4,185,162 | 1/1980 | Bogese, II | 174/115 X |
| 4,220,807 | 9/1980 | Anastasi et al. | 174/117 F X |
| 4,234,759 | 11/1980 | Harlow | 174/115 X |
| 4,381,208 | 4/1983 | Baverstock | 174/117 F X |
| 4,383,725 | 5/1983 | Bogese et al. | 174/117 F X |
| 4,423,282 | 12/1983 | Suzuki et al. | 174/117 F X |
| 4,443,657 | 4/1984 | Hill et al. | 174/117 F X |
| 4,468,089 | 8/1984 | Brorein | 174/117 F X |

*Primary Examiner*—Arthur T. Grimley
*Assistant Examiner*—Morris H. Nimmo
*Attorney, Agent, or Firm*—Mortenson & Uebler

[57] ABSTRACT

An electrical transmission line is provided comprising at least one elongate signal conductor, one or more other conductors placed away from and substantially parallel to said signal conductor, all conductors encased in an outer insulating resin covering having a rectangular cross-section, the signal conductor(s) being further encased in an inner insulating porous resin covering, the porous resin covering having an electrical shielding layer thereover.

4 Claims, 5 Drawing Figures

TRANSMISSION LINE

BACKGROUND OF THE INVENTION

The present invention relates to a transmission line having extremely short signal propagation delay time.

Heretofore there has been proposed a transmission line as shown in FIG. 1. That transmission line 1 is made up of a signal conductor 2 placed at the center of the covering 4, a pair of conductors 3 placed on both sides of the signal conductor 2, and the insulating resin covering 4 such as polyethylene, which is called "form keeping resin material", having a rectangular cross-section. The signal conductor 2 and the conductors 3 are kept parallel to one another at a fixed transverse separation distance. The conductors 3 are either grounding wires for the signal conductor 2 or act as mechanical reinforcement. Only one other conductor may suffice in some cases.

The transmission line 1 of FIG. 1 may be used alone or it may also be used in multiple component cables. In the latter case, a plurality of transmission lines 1 are joined side-by-side by fusion bonding of the covering 4 to form a multiple flat cable 5 shown in FIG. 2. The distance between the signal conductors 2 is usually 1.27 mm.

The conventional transmission line mentioned above has disadvantages. It has a relatively long signal propagation delay time because the electromagnetic wave resulting from signal transmission concentrates in the covering 4 if made of polyethylene resin or the like, as is usual for the form keeping resin material. In the case of a transmission line as shown in FIG. 1, the propagation delay time is about 4.7 nsec/m, and it has heretofore been impossible to reduce it below 4.0 nsec/m for a transmission line of this kind. For the characteristic impedance desired, it is necessary that the conductors 3 be placed as far away as possible from the signal conductor 2. Such an arrangement reduces the thickness of the covering 4 in the vicinity of the surface 4*a*. This leads to insufficient dielectric strength when an electric current is applied to the conductor 3 while the transmission line is used underwater. Moreover, in the case of a multiple component flat cable, it is necessary to keep adjacent conductors 2 an adequate distance apart from one another.

The present device is intended to overcome the above-mentioned disadvantages inherent in the conventional transmission lines of this kind, and to provide a transmission line having improved transmission characteristics.

SUMMARY OF THE INVENTION

An electrical transmission line is provided comprising at least one elongate signal conductor and one or more other elongate conductors placed away from and in substantially parallel relationship to the signal conductor, all conductors being encased in an outer insulating resin covering having a rectangular cross-section, the signal conductor being further encased within an inner insulating porous resin covering, the porous resin covering having an electrical shielding layer thereover. The inner insulating porous resin covering is preferably expanded, porous polytetrafluoroethylene. The outer insulating resin covering is preferably a nonporous fluoroplastic resin. At least one of the other conductors may be bonded to the shielding layer. Also provided is a multiple component transmission line in the form of a flat cable having a plurality of the aforesaid transmission lines joined together in side-by-side relationship. The component transmission lines may be joined together only at discrete intervals along the length of the flat cable.

DETAILED DESCRIPTION OF THE INVENTION AND PREFERRED EMBODIMENTS WITH REFERENCE TO THE DRAWINGS

An electrical transmission line is provided comprising at least one elongate signal conductor, one or more other conductors placed away from and substantially parallel to said signal conductor, all conductors encased in an outer insulating resin covering having a rectangular cross-section, the signal conductor(s) being further encased in an inner insulating porous resin covering, the porous resin covering having an electrical shielding layer thereover.

According to the invention, in other words, there is provided a transmission line made up of a signal conductor enclosed in an inner insulating porous resin layer, a shielding layer of thin metal film, conductive resin, or a magnetic substance formed on the outside of the inner insulating porous resin layer, other conductors parallel to the signal conductor and a covering thereover which encloses all of the above-mentioned components.

The device is described in more detail with reference to the accompanying drawings and the following examples.

Figure 1:
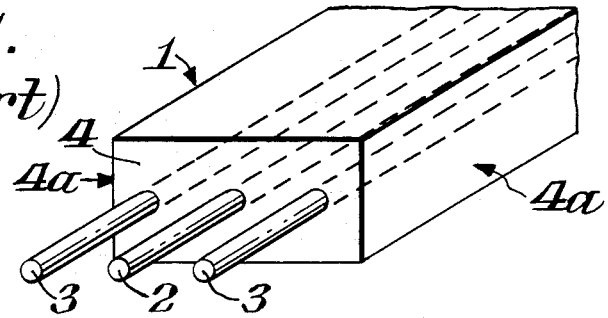
Fig. 1. (Prior Art)
FIG. 1 is a perspective view of one end of a conventional transmission line.
Figure 2:
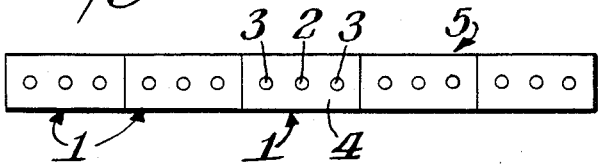
Fig. 2 (Prior Art)
FIG. 2 is an end view of a multiple component flat cable formed by joining together a plurality of the transmission lines of claim 1.
Figure 3:
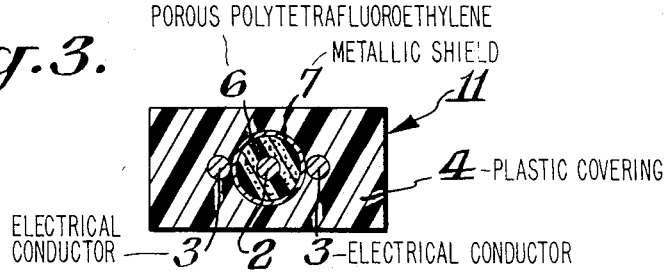
FIG. 3 is an end cross-sectional view of a transmission line according to the invention.

FIG. 3 is an end view of one embodiment of the transmission line of this invention. The transmission line 11 comprises a signal conductor 2 enclosed in an insulating porous resin layer 6, and having a shielding layer 7 of thin metal film surrounding the resin layer 6, other conductors 3 spaced apart from and substantially parallel to conductor 2, and an insulating resin covering 4 covering all components. The shielding layer 7 is not limited to thin metal film, but it may include braided metal wire, wound metal wire, conductive resin, a magnetic substance, and plated metal.

The insulating porous resin layer 6 can comprise polyolefin, polyamide, polyester, or fluoroplastic such as tetrafluoroethylene resin (PTFE), tetrafluoroethylene-hexafluoropropylene copolymer resin (FEP), tetrafluoroethylene-perfluoroalkyl-vinyl ether copolymer resin (PFA), or tetrafluoroethylene-ethylene copolymer resin (ETFE) which has been made porous by either a stretching method, salt leaching method, or solvent evaporation method. Preferred is a stretched expanded porous tetrafluoroethylene resin (EPTFE) produced according to the process disclosed in U.S. Pat. No. 3,953,566. This porous polymer is desirable because of its excellent electrical properties and low dielectric constant. In this example, the layer 6 is formed by winding an EPTFE resin tape around the signal conductor 2.

The EPTFE resin tape is a 0.05 mm thick expanded porous tape prepared by extruding a pasty mixture of tetrafluoroethylene resin (PTFE) fine powder and a liquid lubricant, followed by calendering and lubricant removal, into an unsintered extruded, PTFE tape. This tape is then stretched in the longitudinal direction to three times its original length in an atmosphere kept at about 300° C. The tape is then heated to 360° C. for 10 seconds while held stretched. This tape is nearly fully sintered and has a specific gravity of 0.68.

The covering 4 can be made of any resin which is capable of extrusion molding. Examples of such resins include tetrafluoroethylene resin (PTFE), tetrafluoroethylene-perfluoroalkyl-vinyl ether copolymer resin (PFA), tetrafluoroethylene-hexafluoropropylene copolymer resin (FEP), EPE resin, tetrafluoroethylene-ethylene copolymer resin (FTFE), trifluorochloroethylene resin (PCTFE), and difluorovinylidene resin (PVDF). Not only do these resins have superior electrical properties, but most have excellent adhesion to the shield on the insulated signal conductor 2 and the conductors 3.

To produce the transmission line 11 as shown in FIG. 3, a silver-plated soft copper wire, 0.16 mm in diameter, is provided for the signal conductor 2 and the conductors 3. The signal conductor is wrapped with the above-mentioned EPTFE resin tape which is nearly fully sintered and has a specific gravity of 0.68. The tape-wrapped conductor is heated at 340° C. to provide for complete sintering. There is thus obtained an insulated conductor, 0.4 mm in outside diameter. This insulated conductor is then covered with a shielding layer 7 of thin metal film (Al, Ag, Cu, etc.) by vacuum deposition, plating, or foil winding. The shielding layer should preferably be thicker than 1 micrometer. This conductor and the conductors 3 are then enclosed by extrusion molding within a covering 4 of PFA resin having a rectangular cross-section, measuring 1.3 mm wide and 0.7 mm thick. The insulating porous resin layer 6 can be formed around the signal conductor 2 and the conductors 3 by wrapping the conductor with a tape longitudinally or by extrusion of a porous material. The transmission line 11 thus obtained has a characteristic impedance of 95 ohms and a propagation delay time of 3.8 nsec/m.

In the transmission line of this device the distance between the signal conductor 2 and the conductors 3 can be reduced by about 15% over conventional lines and the propagation delay time is reduced by about 25% from that of a conventional transmission line (characteristic impedance 95 ohms) which has the same conductors and covering as those in the transmission line of this device, but does not have the insulating porous resin layer 6 and the shielding layer 7. In addition, the variation in propagation delay time is reduced and an improvement of about 40% is observed with regard to distortion of transmission pulses. In this example, two conductors 3 are arranged at both sides of the signal conductor 2 and at least one of the two conductors 3 is in contact with the shielding layer 7. The insulating porous resin layer 6 may comprise the porous plastic film having, in addition to the pores in the resin, a large number of through holes which are produced according to the process disclosed in U.S. Pat. No. 4,559,254, entitled "Sheetlike Resin Material". The resulting insulating porous resin layer 6 will have a low dielectric constant and a high compression resistance. Thus, the transmission line employing it will have improved transmission characteristics.

Figure 4:
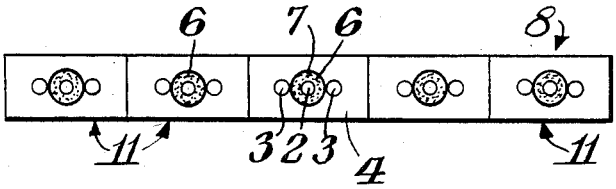
FIG. 4 is an end elevational view of a multiple component flat cable formed by joining together a plurality of the transmission lines of this invention shown in FIG. 3.
Figure 5:
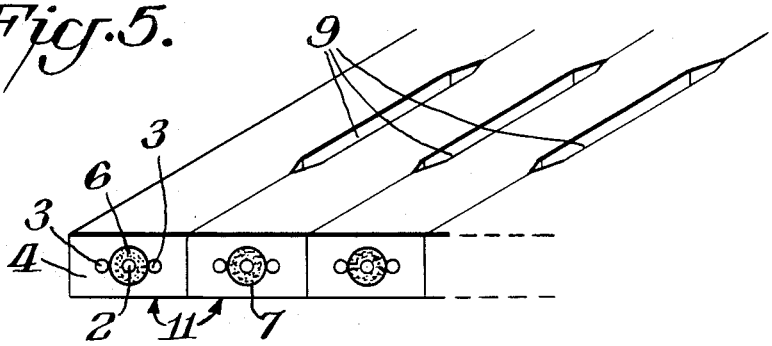
FIG. 5 is a perspective view of one end of a multiple component flat cable formed by joining together a plurality of the transmission lines of the invention only at discrete intervals along the length of the cable, leaving discrete openings through the thickness of the cable between the joined portions.

A plurality of the transmission lines 11 of this invention may be joined side-by-side to form a multiple component flat cable 8 shown in FIGS. 4 and 5. In this case, the component transmission lines may be partially separated from one another at desired intervals as indicated by reference numeral 9 in FIG. 5. Such a structure has an advantage that the individual transmission lines 11 are not subjected to undue tension or compression when the cable is twisted or bent.

As described above, the transmission line of this invention has a low transmission loss and a short propagation delay time because the signal conductor 2 is enclosed within the insulating porous resin layer 6 having a low dielectric constant and being surrounded by the shielding layer 7. Moreover, it has a minimum variation in electrical properties and has a high transmission density owing to the smaller distance between the conductors made possible by the invention. Thus, this device is remarkably and unexpectedly effective in improving the dielectric strength, dimensional stability, and processability of a transmission line. The shielding layer 7 is effective in reducing crosstalk that takes place when the transmission lines are joined together side-by-side to form a multiple flat cable.

According to this invention, the insulating porous resin layer 6 encloses the signal conductor 2 and is covered by shield 7. Without this structure, it would be possible to reduce the propagation delay time even when the insulating porous resin layer 6 is formed around the signal conductor 2 alone. In such a structure, however, the conductor 3, which is used as a grounding wire, is in direct contact with the covering 4. This increases the composite dielectric constant, causing electromagnetic waves to concentrate in the covering 4 and adversely affects the transmission characteristics. These problems have been solved by the present device.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An electrical transmission line comprising at least one elongated signal conductor and one or more other elongated conductors placed away from and in substantially parallel relationship to said signal conductor, all conductors being encased in an outer insulating resin covering having a rectangular cross-section, the signal conductor being further encased within an inner insulating porous resin covering, the porous resin covering having an electrical shielding layer thereover wherein said inner insulating porous resin covering is expanded, porous polytetrafluoroethylene and wherein at least one of said other conductors is bonded to said shielding layer and wherein said porous resin has, in addition to the pores in the resin, a large number of through holes.

2. The transmission line of claim 1 wherein said outer insulating resin covering is a nonporous fluoroplastic resin.

3. A multiple component transmission line in the form of a flat cable having a plurality of transmission lines joined together in side-by-side relationship wherein each said transmission line comprises at least one elongated signal conductor and one or more other elongated conductors placed away from and in substantially parallel relationship to said signal conductor, all conductors being encased in an outer insulating resin covering having a rectangular cross-section, the signal conductor being further encased within an inner insulating porous resin covering, the porous resin covering having an electrical shielding layer thereover wherein said inner insulating porous resin covering is expanded porous polytetrafluoroethylene and wherein at least one of said other conductors is bonded to said shielding layer, and wherein said porous resin has, in addition to the pores in the resin, a large number of through holes.

4. The multiple component transmission line of claim 3 wherein said components are joined together only at discrete intervals along the length of said cable.

* * * * *